US006048249A

United States Patent [19]

Vandenberg

[11] Patent Number: 6,048,249

[45] Date of Patent: Apr. 11, 2000

[54] PLASTIC BUILDING BLOCK TOY CLEANUP VACUUM ATTACHMENT

[76] Inventor: Anthony Peter Vandenberg, 600 Heather La., Charlotte, N.C. 28209

[21] Appl. No.: 09/356,911

[22] Filed: Jul. 19, 1999

[51] Int. Cl.[7] ..... A63H 33/04; A47L 9/02

[52] U.S. Cl. ..... 446/75; 15/418

[58] Field of Search ..... 15/3.11, 350, 352, 15/353, 418; 446/75, 474

[56] References Cited

U.S. PATENT DOCUMENTS

| | | | |
|---|---|---|---|
| 3,775,951 | 12/1973 | Eicholz et al. | 15/418 |
| 4,358,300 | 11/1982 | Schplapman et al. | 15/418 |
| 4,467,494 | 8/1984 | Jones | 15/418 |
| 4,826,514 | 5/1989 | Griffis | 15/418 |

*Primary Examiner*—Sam Rimell

[57] ABSTRACT

A toy cleanup vacuum attachment which can be used easily by attaching to household vacuum hose for the quick and efficient clean up of a plurality of different size and shape plastic building block toys. The toy cleanup vacuum attachment compromises: a curved suction channel for sucking up plastic toy building blocks; a convex plate guide with vent holes which guides the plastic building block toys within a suction channel into a drop channel while allowing the passage of vacuum current and dust; a rectangular drop channel through which plastic building block toys pass from the force of vacuum momentum and gravity; a transparent collection container for housing the plastic building block toys during cleanup and an air-tight bottom, hinged lid for conducting quick and simple dropping of plastic building block toys back into a toy box; a spring loaded push/twist thumb button agitator for dislodging clogged or stuck plastic building block toys; a grip handle for ease of use and insertion of standard household vacuum hose attachment.

1 Claim, 8 Drawing Sheets

PLASTIC BUILDING BLOCK TOY CLEANUP VACUUM ATTACHMENT

BACKGROUND—FIELD OF INVENTION

This invention relates to a vacuum cleaner hose attachment device utilized for the quick and fun cleaning up of a plurality of different size and shape plastic building block toys.

BACKGROUND—DESCRIPTION OF RELATED ART

The popularity of plastic building block toys continues to grow. Sizes and shapes as well as miniature kit types have led to an explosion in the quantity of block numbers in the average household with children. Children tend to play with so many pieces that clean up can be an exhausting chore for both children and parents. Nothing in the patent search was found in which an attachment device for the household vacuum cleaner was used to efficiently gather up a plurality of different size and shape plastic building block toys into a collection container for clean and easy return to a toy box.

OBJECT AND ADVANTAGES

Several objects and advantages of my invention are:

(a) to provide a toy cleanup vacuum attachment which can be easily attached and removed to a standard household vacuum machine hose;

(b) to provide a toy cleanup vacuum attachment which can effectively suck up a plurality of different size and shape plastic building block toys and collect them into a collection container;

(c) to provide a toy cleanup vacuum attachment which can cleanly suck up plastic building block toys while allowing dust and dirt particles to pass through to the vacuum cleaner;

(d) to provide a toy cleanup vacuum attachment which can be easily cleaned from entrance through the bottom of a collection container, should vent holes become clogged with hair, string or other such large foreign objects;

(e) to provide a toy cleanup vacuum attachment with a comfortable and practical grip handle for ease of use;

(f) to provide a toy cleanup vacuum attachment with a spacious collection container with bottom lid opening for quick and simple dropping of plastic building block toys back into a toy box, and an air-tight latch & hinge assembly for securing the lid;

(g) to provide a toy cleanup vacuum attachment which can be quickly unclogged with a simple twist or push of the thumb, should connected plastic building block toys become stuck in the device or flat building block toy pieces become stuck against vent holes;

(h) to provide a toy cleanup vacuum attachment with a clear compartment housing so that the plastic building block toys can be seen as they are cleaned up and deposited into a collection container;

Still further objects and advantages will become apparent from a consideration of the ensuing description and drawings.

DRAWING FIGURES

Figure 1:
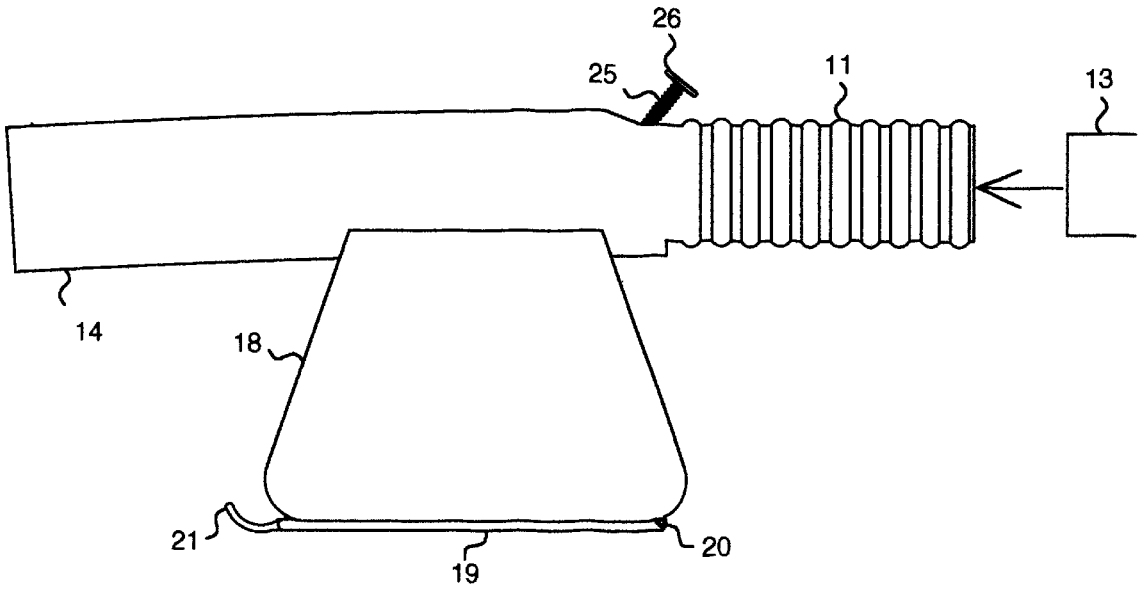

Although the present embodiment of this invention is made from transparent molded thermoplastics, some visible objects behind the target object are not shown for greater figure clarity FIG. 1: shows a side view of various external aspects of the toy cleanup vacuum attachment.

Figure 2:
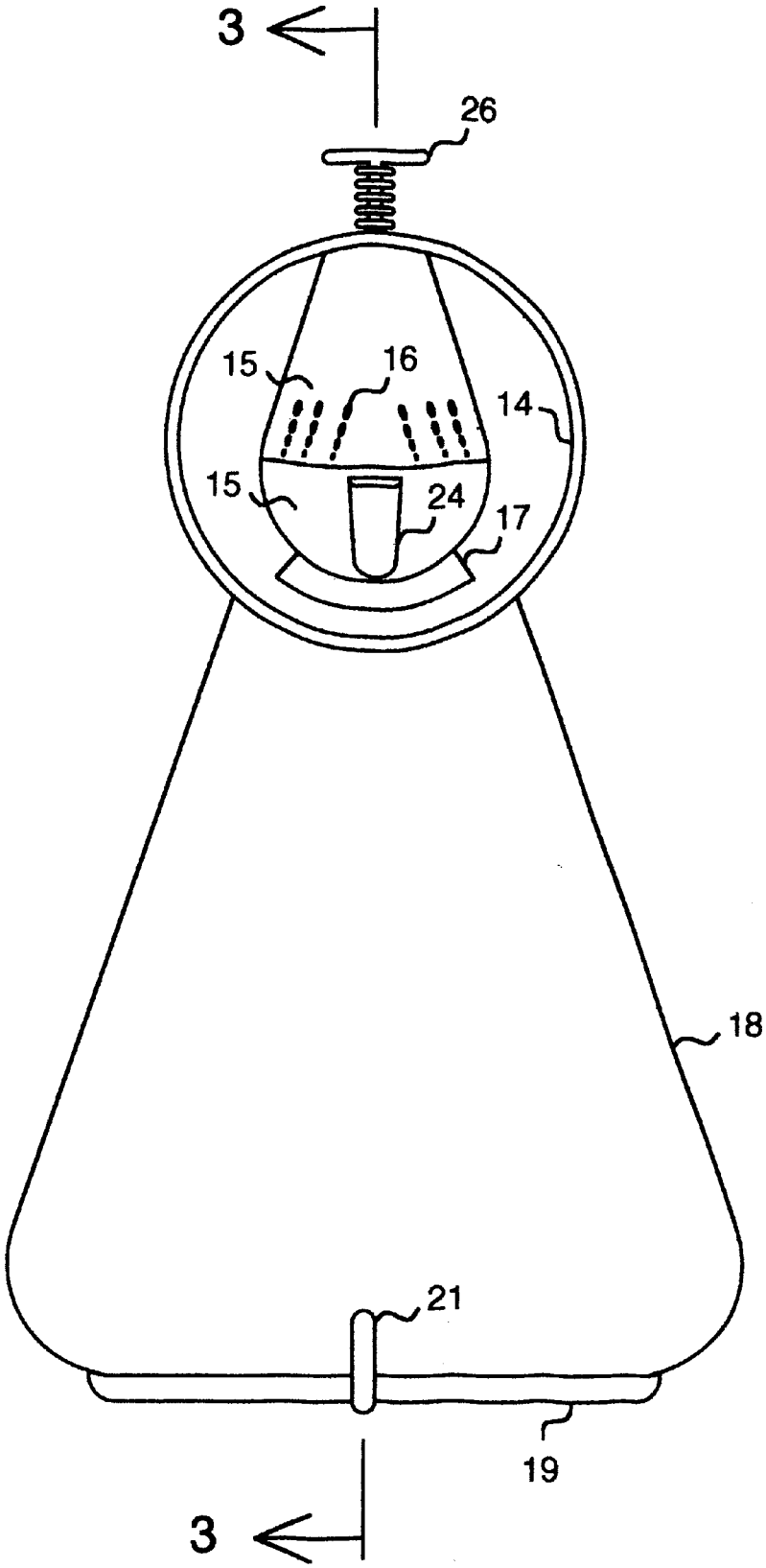

FIG. 2: shows a front view of the toy cleanup vacuum attachment into a suction channel.

Figure 3:
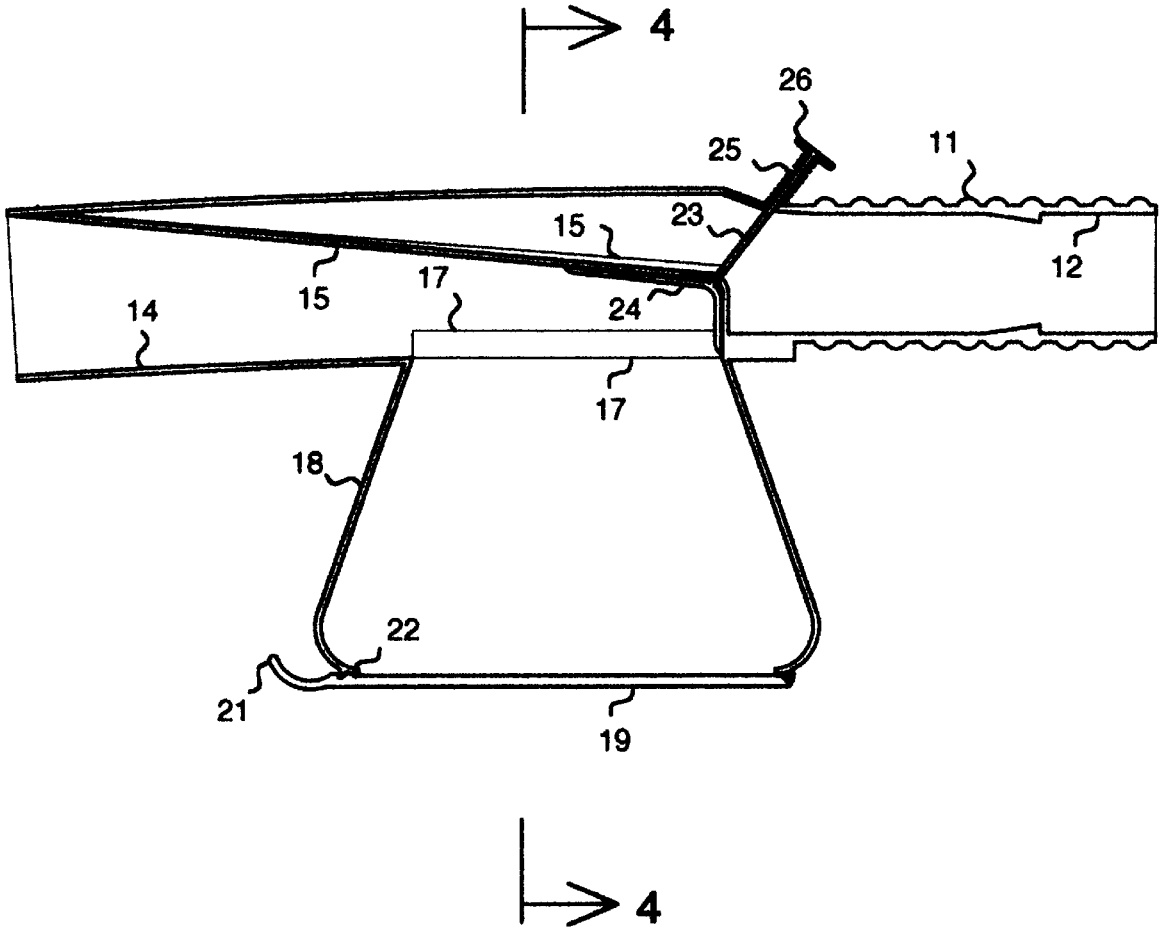

FIG. 3: shows a longitudinal section view through the center of the toy cleanup vacuum attachment and the slant and location of a guide panel, an agitator paddle assembly and a drop channel.

Figure 4:
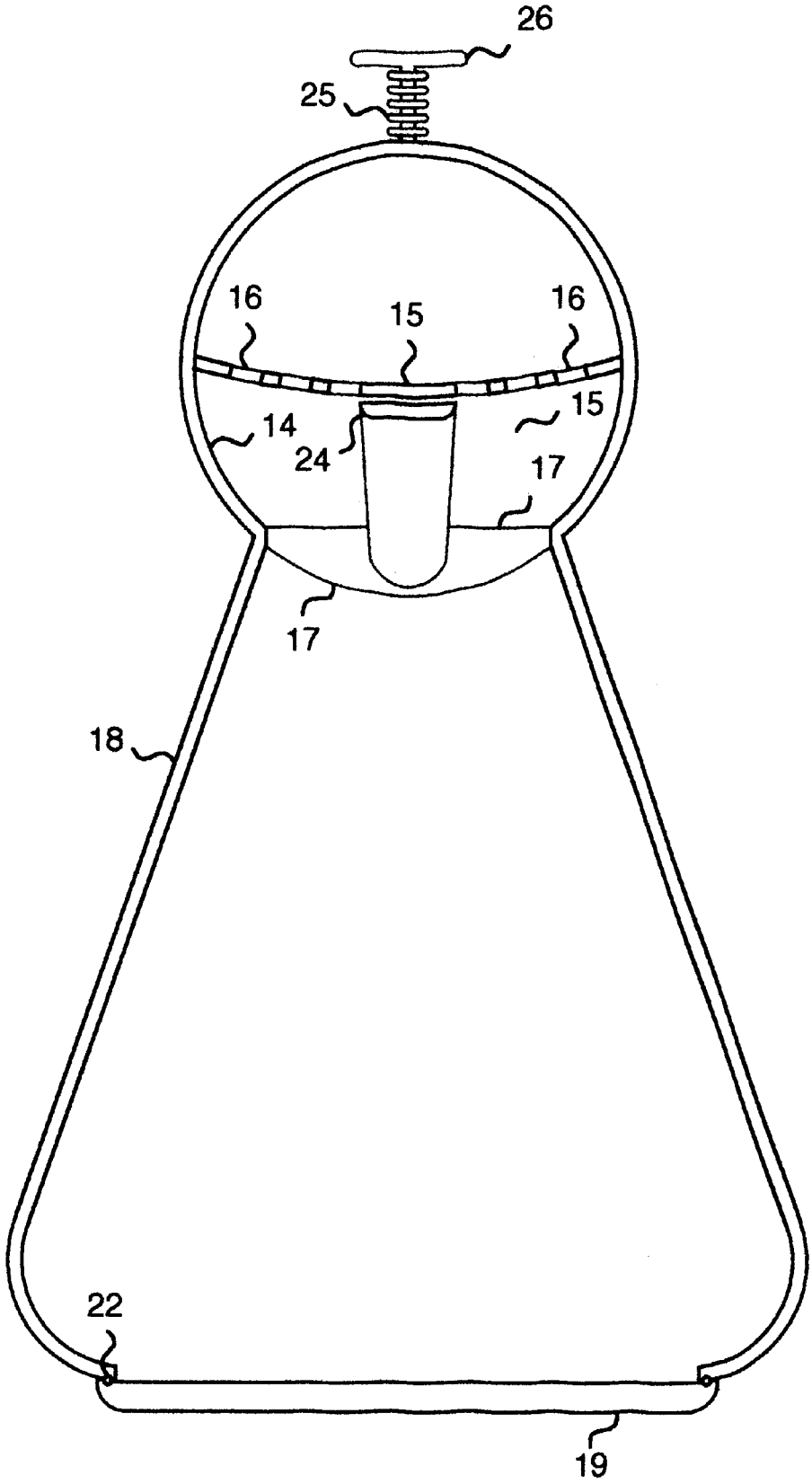

FIG. 4: shows a lateral section view through the toy cleanup vacuum attachment and the curvature of a guide panel and location of vent holes.

Figure 5:
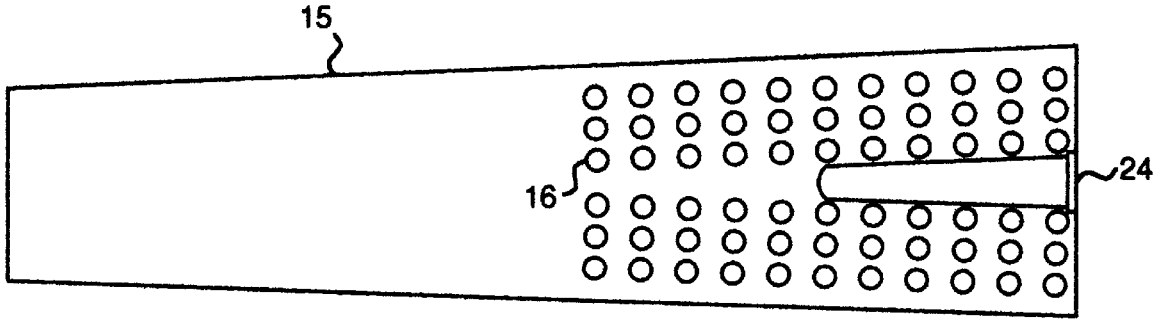

FIG. 5: shows an expanded view of a guide panel when viewed from below and the location of vent holes and an agitator paddle.

Figure 6:
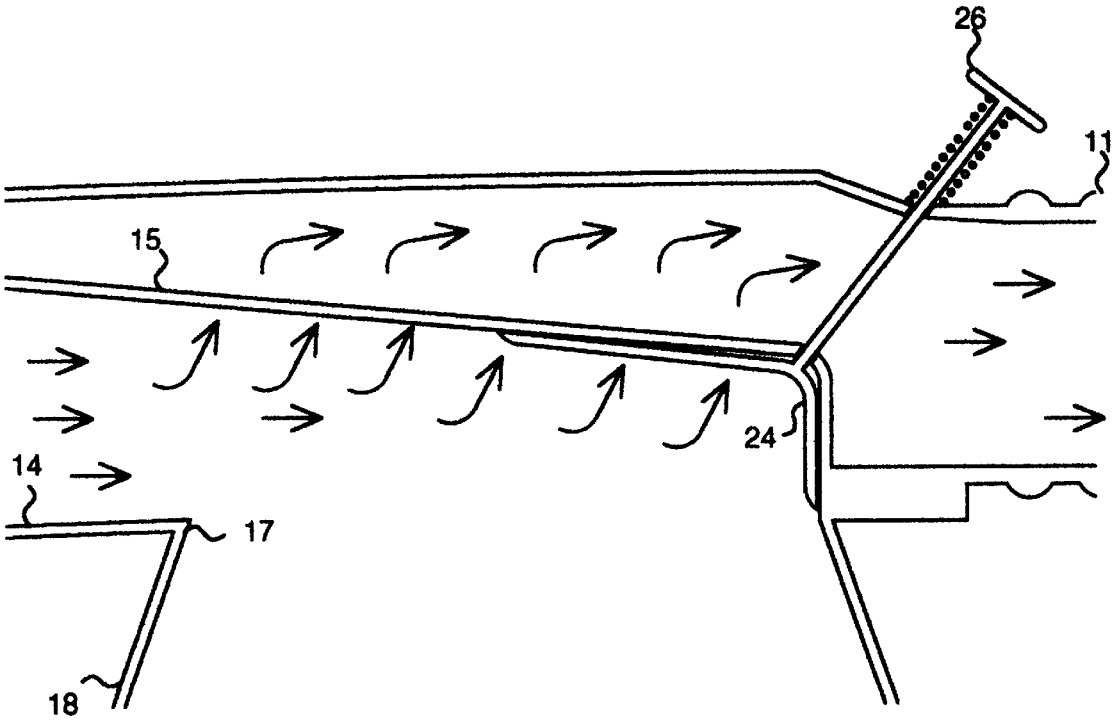

FIG. 6: shows the path the vacuum current follows into a suction channel and through vent holes in a guide panel.

Figure 7:
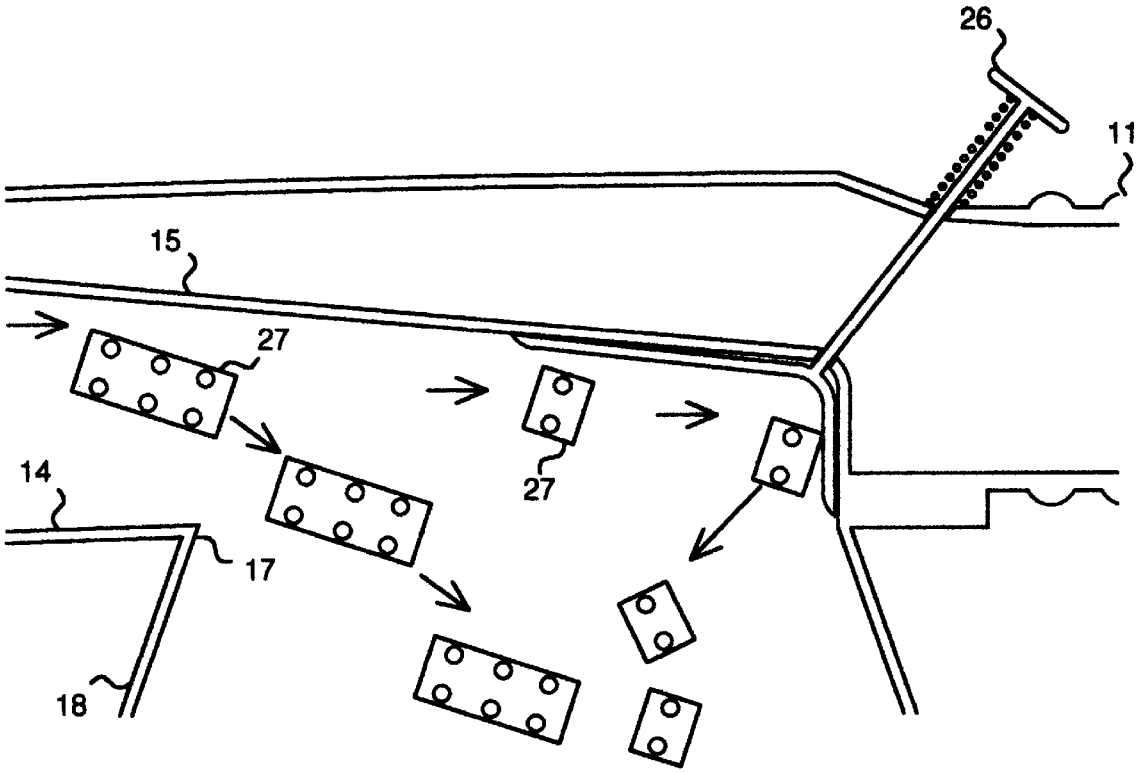

FIG. 7: shows representative plastic building block toys passing through a suction channel and into a collection container.

Figure 8:
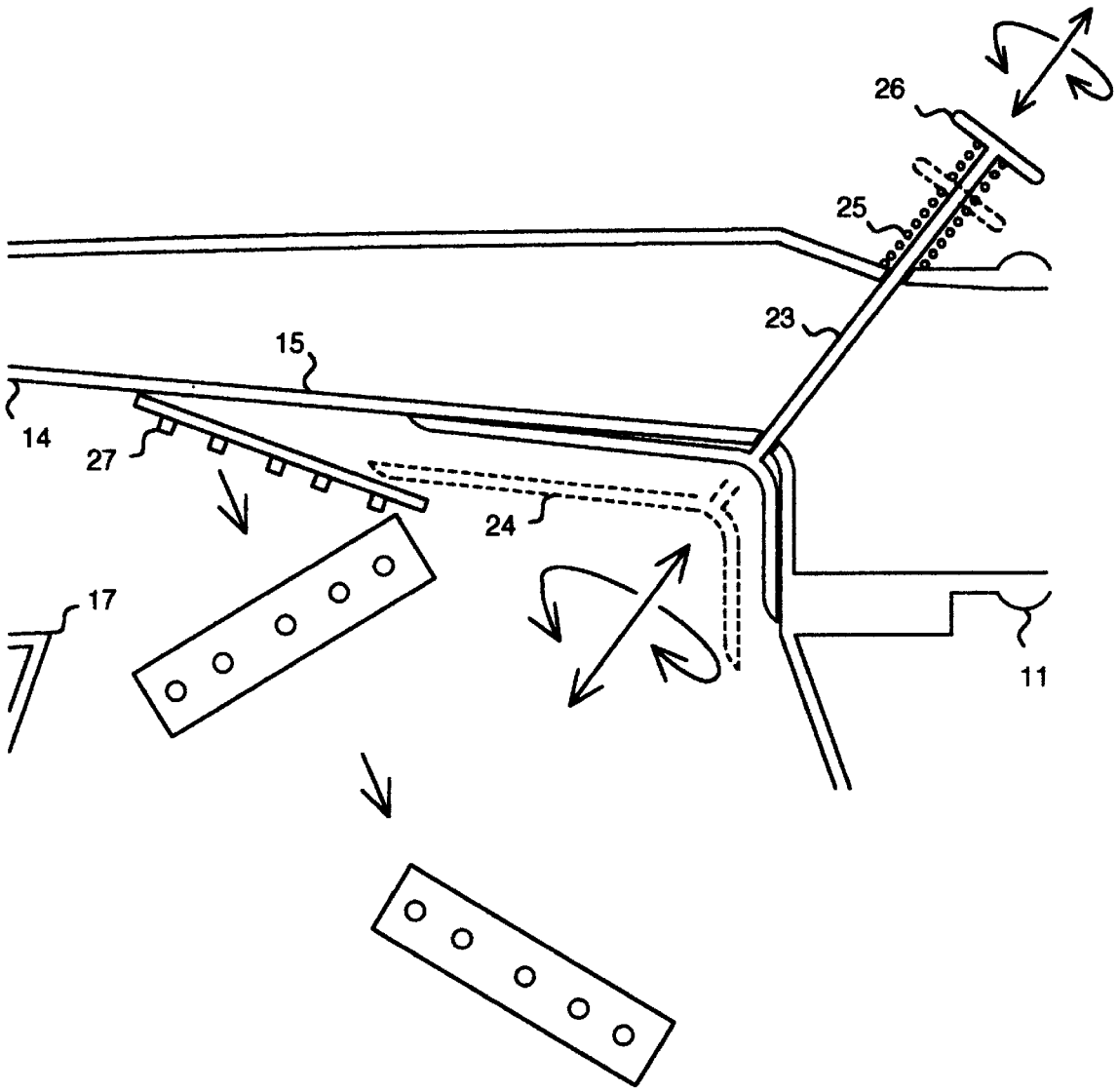

FIG. 8: shows various aspects of the agitator paddle dislodging a flat representative plastic building block toy.

REFERENCE NUMERALS IN DRAWINGS

11 Grip Handle
12 Insertion Receptacle
13 Representative Vacuum Cleaner Hose
14 Suction Channel
15 Plate Guide
16 Vent Holes
17 Drop Channel
18 Collection Container
19 Bottom Lid
20 Hinges
21 Latch
22 O-ring
23 Agitator Rod
24 Agitator Paddle
25 Return Spring
26 Push & Twist Button
27 Representative Plastic Building Block Toys

SUMMARY

In accordance with the present invention a transparent toy cleanup vacuum attachment which compromises: a curved suction channel for sucking up plastic toy building blocks; a convex plate guide with vent holes which guides the plastic building block toys within a suction channel into a drop channel while allowing the passage of vacuum current and dust; a rectangular drop channel through which plastic building block toys pass from the force of vacuum momentum and gravity; a transparent collection container for housing the plastic building block toys during cleanup and an air-tight bottom, hinged lid for conducting quick and simple dropping of plastic building block toys back into a toy box; a spring loaded push/twist thumb button agitator for dislodging clogged or stuck plastic building block toys; a grip handle for ease of use and insertion of standard household vacuum hose; for the purpose of providing quick, fun, and efficient cleanup of a plurality of different size and shape plastic building block toys.

Description—FIGS. 1–8

A typical embodiment of the toy cleanup vacuum attachment of the present invention is illustrated in FIGS. 1–8. The present embodiment of this invention is for utilization with LEGO® brand size and shape plastic building blocks. This embodiment is for utilization with block sizes and shapes smaller than 30 mm width×100 mm length×20 mm height either single or connected (LEGO® is a trademark of INTERLEGO AG. and the LEGO® Group of Companies). All portions of this invention, except the grip handle, push & twist button, and return spring, are made from transparent molded thermoplastics. Other embodiments of this invention may include different dimensional configurations to accommodate larger size plastic building block toys.

The toy cleanup vacuum attachment has a grip handle 11. Grip handle 11 typically has dimensions of 52 mm diameter×150 mm length (cylindrical and hollow). At the back end, grip handle 11 has a 42 mm inner diameter insertion receptacle 12 to accept snug attachment of a typical household vacuum hose 13. Grip handle 11 is integrally connected at the front end to a suction channel 14. Vacuum hose 13 is inserted into insertion receptacle 12 and vacuum current flows through grip handle 11 from suction channel 14, FIG. 1 and FIG. 6.

Suction channel 14 is typically 60 mm outer diameter× 250 mm length (cylindrical and hollow) with outer most curvature radius of 4,000 mm in longitudinal direction. The curvature allows for easy angle of clean-up alignment with floor for the operator, FIG. 1 and FIG. 3. A panel guide plate 15, begins at the top, interior front of suction channel 14 and runs back and down a chord length distance of 250 mm to an elevation of 30 mm above the bottom of suction channel 14, before curving straight down in 5 mm radius and joining perpendicular to the bottom of suction channel 14. Plate guide 15 is welded to the interior of suction channel 14 on all edges. The slanted portion of plate guide 15 has a radius of 115 mm with the surface of the plate protruding down. The vertical portion of plate guide 15 is flat with no radius. On the rear slanted portion of plate guide 15 are a series of 66 4 mm diameter vent holes 16, FIG. 4 and FIG. 5. Vent hole 16 openings are perpendicular to the surface curvature and offset equidistantly from the longitudinal center line of plate guide 15, FIG. 5.

Vent holes 16 allow a vacuum current to form that carries plastic building block toys 27 towards the back of suction channel 14, FIG. 6 and FIG. 7. Vent holes 16 also allow for the passage of small dust particles past guide plate 15 and into vacuum cleaner through the hollow portion of grip handle 11. The convex curved surface of plate guide 15 and positioning of vent holes 16 prevents flat surfaces of plastic building blocks toys 27 from becoming sucked up against and stuck to vent holes 16. The narrowing passage of suction channel 14 created by plate guide 15 forces slow moving plastic building block toys 27 to collect directly into a drop channel 17, and fast moving plastic building block toys 27 to hit the rear vertical portion of guide plate 15 before bouncing back and down into drop channel 17, FIG. 7.

Drop channel 17 is a 40 mm width×100 mm length rectangular hole located directly below vent holes 16. Plastic building block toys 27 are driven into drop channel 17 by the momentum caused by the vacuum current in suction channel 14 as well as by gravity. Dropping plastic building block toys 27 fall through drop channel 17 and into a collection container 18, FIG. 2 and FIG. 7. Collection container 18 is 170 mm length×125 mm width at base, 110 mm length×50 mm at top×125 mm height. The top edge of collection container 18 is integrally connected around the perimeter of drop channel 17. The bottom of collection container 18 has a lid 19 which opens down and out on two hinges 20. Between lid 19 and base of collection container 18 is a continuous rubber O-ring 22, FIG. 3, and FIG. 4. Lid 19 is secured snugly into place compressing O-ring 22 for prevention of air passage and held closed by a latch 21 located at the front bottom of collection container 18. When full, collection container 18 can be emptied by releasing latch 21 and allowing collected plastic building block toys 27 to drop out and into a toy box.

The positioning of vent holes 16 directly above drop channel 17 allows for the accessible cleaning of vent holes 16 through collection container 18 and lid 19 and also allows flat plastic building block toys 27 stuck to vent holes 16 to drop directly into drop channel 17 when vacuum current has been stopped.

At the apex of the curved back portion of plate guide 15 is a hole through which passes a 2 mm diameter agitator rod 23. Agitator rod 23 protrudes into the back corner of suction channel 14 and is attached to an agitator paddle 24. Agitator paddle 24 is L-shaped with radially chamfered side edges and typical dimensions of 13 mm width×55 mm length×25 mm height. The opposite end of agitator rod 23 passes through a hole at the top of grip handle 11, through a return spring 22 and ends in a push & twist button 26, FIG. 8. Hole tolerance for agitator rod 23 in grip handle 11 is snug to prevent loss of vacuum power. Push & twist button 26 can be depressed and rotated to cause agitator paddle 24 to break up stuck or clogged plastic building block toys 27 immediately above drop channel 17 in suction channel 14. When push & twist button 26 is released, return spring 25 pushes agitator paddle 24 back to its original position flush against the curved corner of plate guide 15, FIG. 3 and FIG. 8.

Operation—FIGS. 1–8

The toy cleanup vacuum attachment must be utilized with a typical household vacuum machine hose ending in plastic coupler. For the present embodiment of this invention, the vacuum machine hose coupler outer diameter must be within 40 to 43 mm range and the plastic building block toys should be LEGO® brand type and smaller than 30 mm width×100 mm length×20 mm height, either single or connected (LEGO® is a trademark of INTERLEGO AG. and the LEGO® Group of Companies).

After vacuum hose 13 has been attached into insertion receptacle 12, and the power to vacuum has been turned on, the front opening of suction channel 14 is placed over plastic building block toys 27. Plastic building block toys 27 are sucked into suction channel 14 and deposited into collection container 18. When clean up is completed, lid 19 is opened by releasing latch 21 and plastic building block toys 27 are dropped out of collection container 18 and into a toy box. Lid 19 is fastened back into place compressing O-ring preventing vacuum current from being formed in collection container 18 and latch 22 is closed.

In the event of clogging or flat, thin plastic building block toys becoming stuck to the surface of vent holes 16, push & twist button 26 can be depressed and rotated by the operator's thumb to break up the clogged plastic building block toys 27 causing them to fall into drop channel 17. The operator can also simply cut the power to vacuum cleaner or place hand over suction channel 14 opening to stop the vacuum current and plastic building block toys 27 will drop into drop channel 17 when the vacuum current through vent holes 16 has ceased.

Summary, Ramifications, and Scope

Accordingly, the reader will see that my invention will be simple and clean to operate, as well as efficiently speed up the process of cleaning up scattered plastic building block toys. Furthermore, my invention has the additional advantages in that:

(a) it provides guardians and parents a clean and efficient method for cleaning up after their children.

(b) it provides guardians and parents a safe way to vacuum under beds, furniture and other low visibility conditions without the fear of losing plastic building block toys into the vacuum cleaner bag.

(c) it allow children to experience first hand vacuum current processes and cause-effect relationships particularly in terms of effort and reward through the cleanup process.

Although the description above contains many specificities, these should not be construed as limiting the scope of the invention but as merely providing illustrations of some of the presently preferred embodiments of this invention. For example the toy cleanup vacuum attachment could:

(a) have components with different shapes, levels of transparency, or portions colored or translucent;

(b) have a different dimension configurations to accommodate larger plastic building block toys;

Thus the scope for the invention should be determined by the appended claims and their legal equivalents, rather than by the examples given.

I claim:

1. A toy cleanup vacuum attachment for use with a household vacuum cleaner hose for cleaning up a plurality of different size and shape plastic building blocks, comprising:

(a) a linear suction channel for sucking up plastic building blocks, said suction channel including a cylindrical wall;

(b) a curved and vented plate guide extending diagonally across said suction channel within said cylindrical wall;

(c) a curved and vented paddle extending along a portion of said plate guide;

(d) an actuator rod connected to said paddle and extending through said plate guide and cylindrical wall to permit external actuation of said paddle;

(e) spring means for resiliently mounting said actuator rod to said cylindrical wall; and (f) a collection container communicating with said suction channel wherein plastic building blocks passing through said suction channel are deflected by said vented plate guide into said collection container and plastic building blocks which become trapped against plate guide are forced into said collection container by movement of said actuator rod which moves said paddle against said trapped building blocks.

* * * * *